US005757667A

United States Patent [19]

Shannon et al.

[11] Patent Number: 5,757,667

[45] Date of Patent: May 26, 1998

[54] SOLID STATE PRESSURE DETECTOR FOR BEVERAGE DISPENSERS

[75] Inventors: Joseph W. Shannon, Kent; Ming Zhang, Akron, both of Ohio

[73] Assignee: IMI Wilshire Inc., Anoka, Minn.

[21] Appl. No.: 644,322

[22] Filed: May 10, 1996

[51] Int. Cl.[6] ..... B67D 5/08; B67D 5/54; F04B 49/02; F04B 49/08

[52] U.S. Cl. ..... 364/510; 364/479.14; 222/65; 222/66

[58] Field of Search ..... 364/510, 479.11, 364/479.12, 479.14; 221/1, 6; 222/65, 66, 129.1, 129.2, 129.4; 141/95, 198, 192, 193, 206

[56] References Cited

U.S. PATENT DOCUMENTS

| | | | |
|---|---|---|---|
| 3,675,819 | 7/1972 | Hanson | 222/51 |
| 3,756,464 | 9/1973 | Fuqua | 222/57 |
| 3,790,028 | 2/1974 | Gardner, Jr. et al. | 222/129.4 |
| 3,851,127 | 11/1974 | Gardner, Jr. et al. | 200/61.86 |
| 3,991,911 | 11/1976 | Shannon et al. | 222/25 |
| 3,995,167 | 11/1976 | Kulig | 250/577 |
| 4,467,941 | 8/1984 | Du | 222/1 |
| 4,488,664 | 12/1984 | Cleland | 222/56 |
| 4,544,328 | 10/1985 | Credle, Jr. | 417/33 |
| 4,560,089 | 12/1985 | McMillin et al. | 222/14 |
| 4,616,978 | 10/1986 | Matheson et al. | 417/2 |
| 4,717,945 | 1/1988 | Coppola | 222/64 |
| 4,728,005 | 3/1988 | Jacobs et al. | 222/64 |
| 4,795,061 | 1/1989 | Peckjian | 222/66 |
| 4,821,925 | 4/1989 | Wiley et al. | 222/129.4 |
| 4,896,101 | 1/1990 | Cobb | 324/73.1 |
| 4,957,220 | 9/1990 | Du | 222/66 |
| 5,082,143 | 1/1992 | Schramm, Jr. | 222/66 |
| 5,133,482 | 7/1992 | Burrows et al. | 222/185 |
| 5,228,597 | 7/1993 | Low . | |
| 5,360,140 | 11/1994 | Senghaas | 222/52 |
| 5,608,643 | 3/1997 | Wichter et al. | 374/479.14 |

*Primary Examiner*—Emanuel T. Voeltz
*Assistant Examiner*—Tony M. Cole
*Attorney, Agent, or Firm*—Vickers Daniels & Young

[57] ABSTRACT

A beverage dispenser with an out of syrup detector is described. The detector analyzes the electrical current drawn by a solenoid valve controlling the flow of syrup. Parameters of the current are compared to known parameters indicative of proper back pressure and known parameters indicative of an out of syrup condition.

37 Claims, 4 Drawing Sheets

SOLID STATE PRESSURE DETECTOR FOR BEVERAGE DISPENSERS

BACKGROUND OF THE INVENTION

This invention relates to the art of post-mix beverage dispensers and, more particularly, to an improved system for controlling the flow of syrup and detecting when a syrup reservoir is empty.

Post-mix beverage dispensers are well known and commercially available from a number of sources. These beverage dispensers find commercial application in restaurants, at amusement parks, and in other locations where people gather and desire beverages. In recent years, the technology of beverage dispensing has evolved rapidly to meet demanding situations. Numerous restaurants are geared to providing fast service to large numbers of people at mealtimes. These include chain restaurants operating throughout the United States and elsewhere. Amusement park beverage vendors also must serve very large numbers of people very quickly. Consumers demand high quality drinks and demand them immediately.

Typically, a post-mix beverage dispenser includes a source of syrup, a source of soda, a pump to move the syrup, a chiller to cool the syrup and soda and a tower supporting valves which control the flow of syrup and soda, mix the syrup and soda and dispense the mixed beverage into a cup. The above described basic elements can take different forms. For instance, the chiller can be a mechanically refrigerated ice bank containing tubes for syrup and soda or it can be a cold plate consisting of a block of aluminum having tubes running through it with ice on top of that aluminum mass. The source of syrup can be a bag-in-box type reservoir or pressurized canister. No matter what particular elements are used, virtually all of these systems include a source of syrup and a solenoid operated dispensing valve controlling the flow of syrup at the dispensing tower.

One of the problems associated with these systems is inconsistent operation when the source of syrup or carbon dioxide gas is exhausted. Often, the source of syrup or carbon dioxide gas is in a location remote from the dispensing tower. The source of syrup does not generally present a visually apparent indication when it is running out of syrup. In a bag-in-box type reservoir, the syrup is surrounded by a cardboard box and not normally visible to a beverage dispensing operator. Pressurized canisters are also opaque. It is difficult to determine when such reservoirs are approaching the empty state. If one continues to dispense beverages when the syrup reservoir is empty, a number of things can happen. The beverage dispenser can continue to dispense as best it can. This results in a drink consisting almost entirely of soda and an unhappy customer. The beverage dispenser can begin to spit slugs of gas as well as bits of syrup from the nozzle when a dispense is attempted. This results in a mess as well as a bad drink. The beverage dispenser can gradually decrease the amount of syrup delivered to the valve and deliver a gradually poorer and poorer drink before completely running out. This results in a number of unhappy customers. Other problems occur as carbon dioxide gas is exhausted.

SUMMARY OF THE INVENTION

In accordance with the present invention, a beverage dispenser with an out of syrup detector is provided which detects when a syrup reservoir is exhausted, refuses to deliver out of specification beverages, and alerts the operator to the out of syrup condition.

Further in accordance with the invention, an out of syrup detector is provided which uses an electrical detection means not requiring a sensor in direct contact with the syrup to be dispensed.

Still further in accordance with the invention, an out of syrup detector and control system is provided which monitors the characteristics of electric power delivered to the syrup control solenoid and uses this information to determine when an out of syrup condition exists.

Still further in accordance with the invention, current to the syrup control solenoid is analyzed and the characteristics of the current drawn by the solenoid are used to determine whether syrup is still being delivered or if an out of syrup condition exists.

Still further in accordance with the invention, a syrup detector and controller is provided which digitally encodes information concerning current draw by a syrup control solenoid, digitally analyzes this information and determines whether syrup is available or not available to the beverage dispenser.

Still further in accordance with the invention, a signal detector is provided which looks for current characteristics such as a double peak in a current waveform, a measurable phase change in the current delivered to a solenoid, or a difference in amplitude of current indicative of an out of syrup condition.

It is the primary object of the present invention to provide an out of syrup sensor for a beverage dispensing unit which is accurate and reliable.

It is a further object of the present invention to provide an out of syrup or carbon dioxide gas detector and indicator which does not require a sensor in direct contact with the syrup being delivered.

It is yet another object of the present invention to provide an out of syrup detector relying upon totally electrical measurements and using no additional moving parts.

It is another object of the current invention to provide an out of syrup detector and syrup controller which can be integrated into existing systems with a minimum of changes.

It is another object of the present invention to provide an out of syrup sensor and syrup controller which does not require plumbing changes to existing systems.

Other objects, advantages and novel features of the invention will become apparent from the following detailed description of the invention when considered in conjunction with the accompanying drawings.

BRIEF DESCRIPTION OF THE DRAWINGS

FIG. 6 is a schematic representation of the electrical circuitry implementing a second embodiment of the invention with the syrup delivery system seen in FIG. 1.

DESCRIPTION OF THE PREFERRED EMBODIMENT

Figure 1:
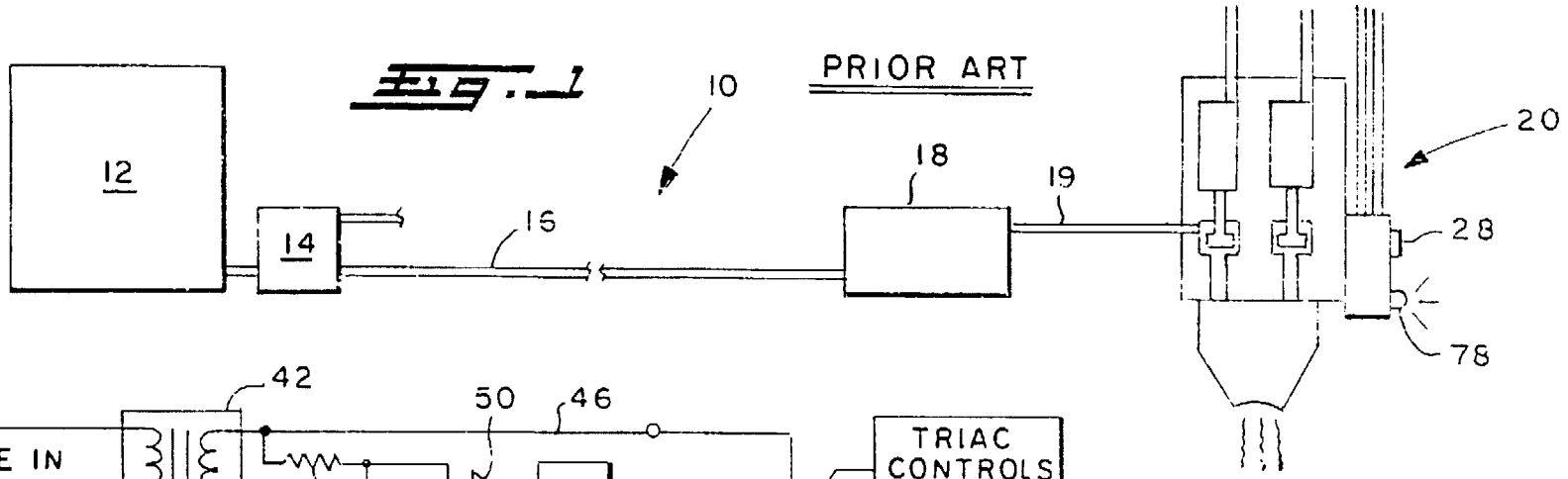
FIG. 1 is a schematic representation of the syrup circuit of a post-mix cold beverage dispensing system.

Referring now in greater detail to the drawings, wherein the showings are for the purpose of illustrating a preferred embodiment of the invention only and not for limiting the invention, FIG. 1 shows a typical syrup delivery system 10 for a post-mix beverage dispenser. Syrup is provided in a reservoir 12. Typically, the reservoir 12 is a bag-in-box container or a metallic canister. The bag-in-box type reservoir is becoming more common and is shown in FIG. 1. A pump 14 draws syrup from the reservoir 12 and pumps it into a syrup conduit 16. The syrup conduit 16 carries the syrup to a chiller 18. The chiller 18 is often a mechanical refrigeration appliance or is a cold plate. A cold plate typically consists of a block of aluminum metal having a tube carrying the syrup imbedded in the aluminum. Ice is then placed on the plate cooling it and the syrup which passes through the plate.

The syrup then passes through a second syrup conduit 19 to a beverage dispensing valve 20. The beverage dispensing valve 20 includes a solenoid valve 22 controlling the flow of syrup. The solenoid valve 22 is normally closed with a valve stem 24 closing a valve seat 26. When it is desired to dispense a beverage, a switch 28 is actuated. The switch is shown in FIG. 1 as a push button switch. The switch 28 will often take the form of a lever disposed below the beverage dispensing valve 20 actuated by pushing the cup against the lever.

When it is desired to dispense a beverage, the switch 28 is actuated which energizes the syrup solenoid valve 22 and a similar soda solenoid valve 30. The syrup and soda are metered by flow control elements within the dispensing valve 20 and mixed together in mixing and nozzle elements in the dispensing valve 20 and dispense into a cup. The above described structures and operation are conventional. Beverage dispensing systems including these elements and operating in this manner are available commercially.

The above described beverage dispensing apparatus occasionally exhausts all of the syrup in the reservoir 12. When this occurs, insufficient syrup is delivered to the dispensing valve 20. Quality drinks can no longer be dispensed. However, several low quality drinks may be dispensed before the operator realizes that syrup starvation is occurring.

Applicants have discovered that an out of syrup condition can be detected by monitoring the electrical current used to open the syrup solenoid valve 22. The circuit used to perform this monitoring is illustrated in FIG. 2.

Syrup solenoid valve 22 operates on 24-volt alternating current. This current is conventionally provided by a transformer which steps down available line current from 110 volts or 240 volts to the 24 volts required. Conventionally, this current is simply switched by means of a microswitch or the like to energize or de-energize the solenoid valve 22. In the present invention, a triac 40 is used to perform this switching function. A triac is a solid state electronic switch and allows more precise control in the present invention.

Figure 2:
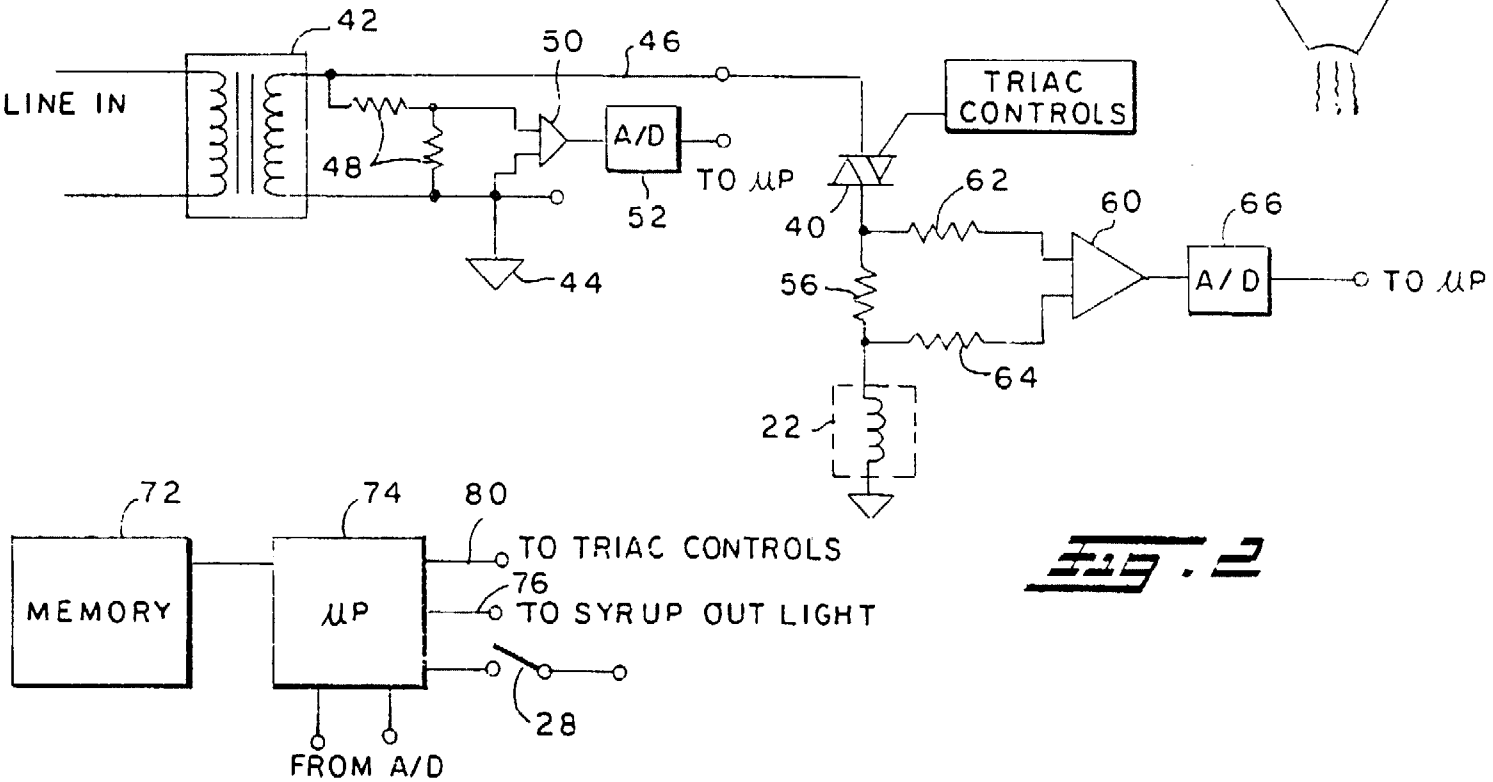
FIG. 2 is a schematic representation of the electrical circuitry implementing the present invention with the syrup delivery system seen in FIG. 1.

As seen in FIG. 2, a transformer 42 provides 24-volt alternating current. As is conventional, one of the transformers secondary leads is tied to a reference ground 44. The second transformer secondary lead 46 is used to provide power to the solenoid valve 22. The triac 40 is in series with the solenoid valve 22. When the triac 40 is switched on, current flows through the solenoid valve 22 and syrup may be dispensed. In the normal state, that is when a beverage is not being dispensed, the triac 40 is in the off condition and current is not provided to the solenoid valve 22.

A resistor divider 48 is connected between the power lead 46 and the ground lead 44 of the transformer secondary. An operational amplifier 50 has its two inputs connected one on either side of the resistor divider 48 and its output connected to an analog to digital converter 52. The analog digital converter 52 provides a digital representation of the voltage on the power lead 46.

A low value resistor 56 is connected in series with the triac 40 and the syrup solenoid valve 22. An operational amplifier 60 has its two inputs connected through resistors 62, 64 to both sides of the resistor 56. The operational amplifier 60 performs a differential amplification of the voltage appearing on both sides of the resistor, thereby deriving the voltage drop across the resistor and hence the current through the resistor 56. The analog output of the operational amplifier 60 is provided to an analog digital converter 66 which provides a digital representation of the current through the resistor 56. As the resistor 56 is in series with the syrup solenoid valve 22, this is a reading of the current delivered to the syrup solenoid valve 22.

The sampling rate of the analog digital converter 66 is sufficiently high to provide a good digital representation of a 60 or 50 Hz 24-volt power waveform.

Figure 3:
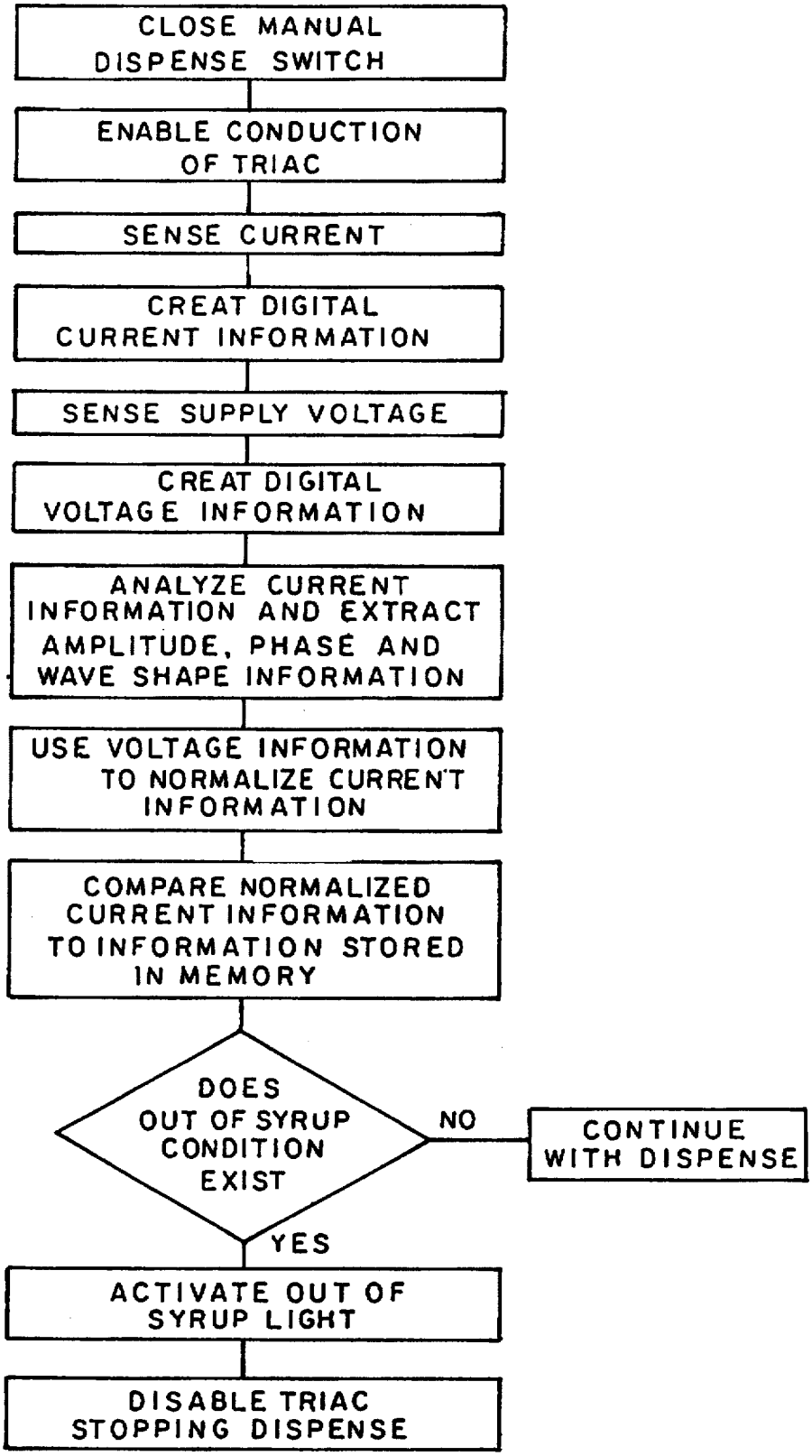
FIG. 3 is a schematic flow diagram showing operations of the circuit of FIG. 2.

The output of the analog digital converter 66 is provided to a microprocessor 74 having a memory 72. The microprocessor 74 performs signal processing operations on the first half wave of current flowing to the syrup solenoid valve 22 through the resistor 56 in each dispense cycle. A half wave of 60 Hz power, as used in the United States, is less than 1/100 of a second in duration. The microprocessor 74 can analyze the half cycle very quickly and make a decision as to whether syrup is present or not before a dispense is really commenced. The analysis process 90 is shown in FIG. 3.

Figure 4:
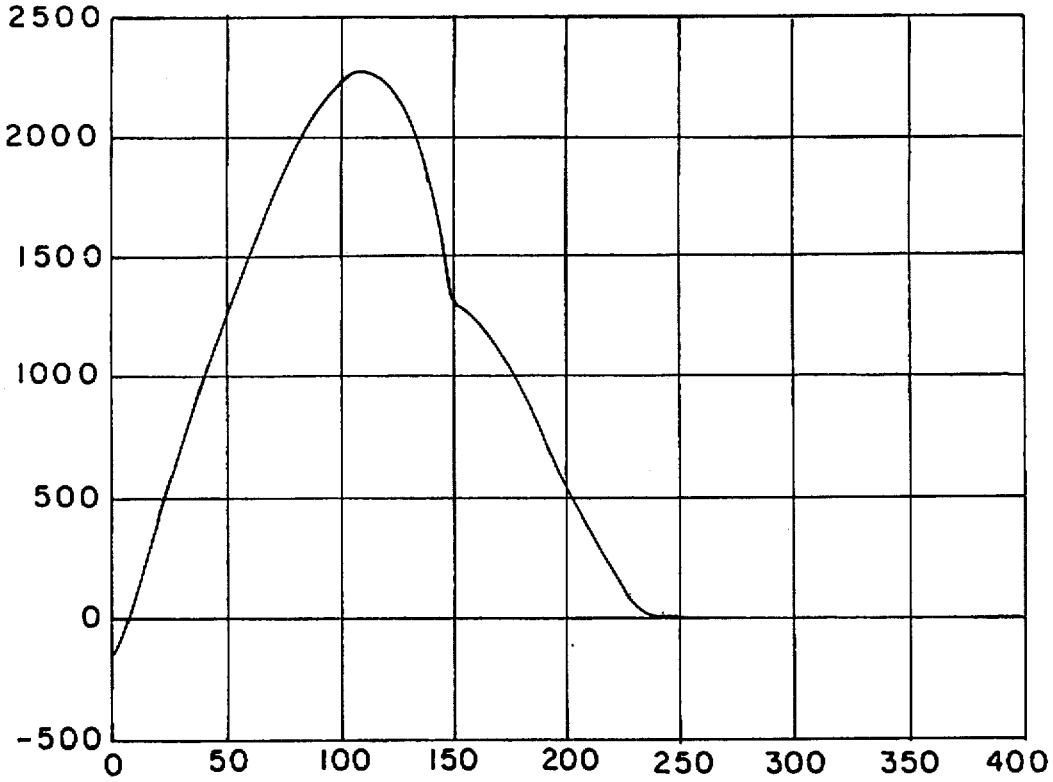
FIG. 4 is a waveform tracing showing a half wave of the current analyzed by the circuit of FIG. 2 when the syrup delivery system is operating normally.
Figure 5:
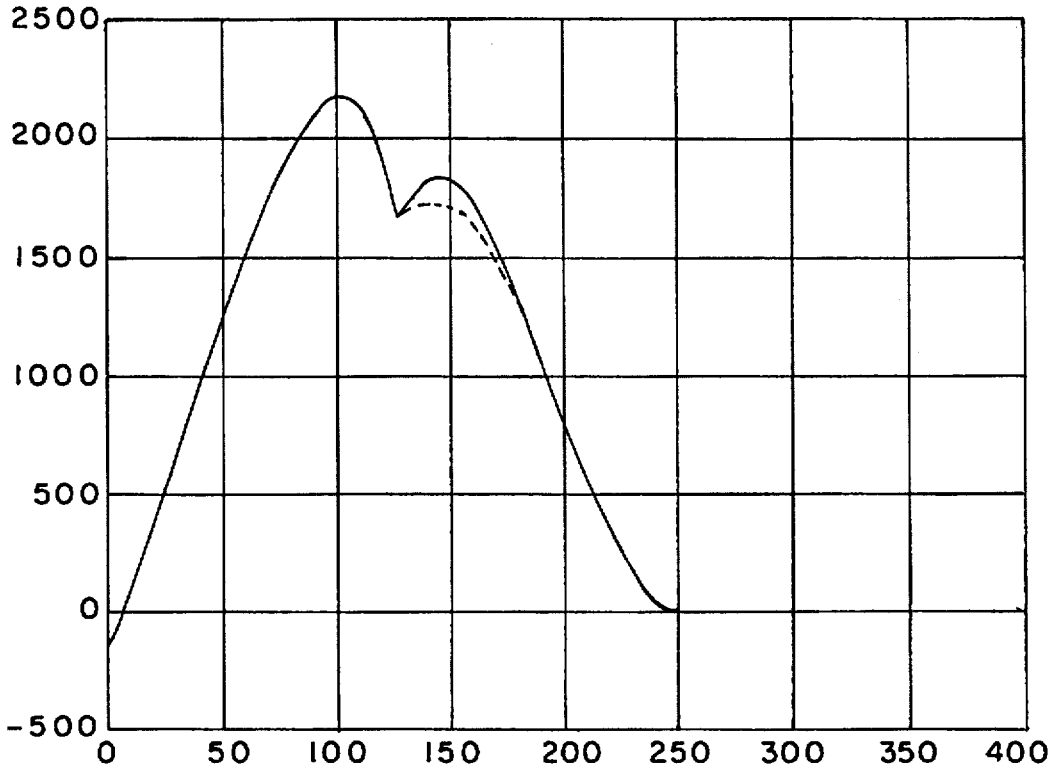
FIG. 5 is a waveform tracing showing the current sensed in the circuit of FIG.2 indicative of an out of syrup condition.
Figure 5:
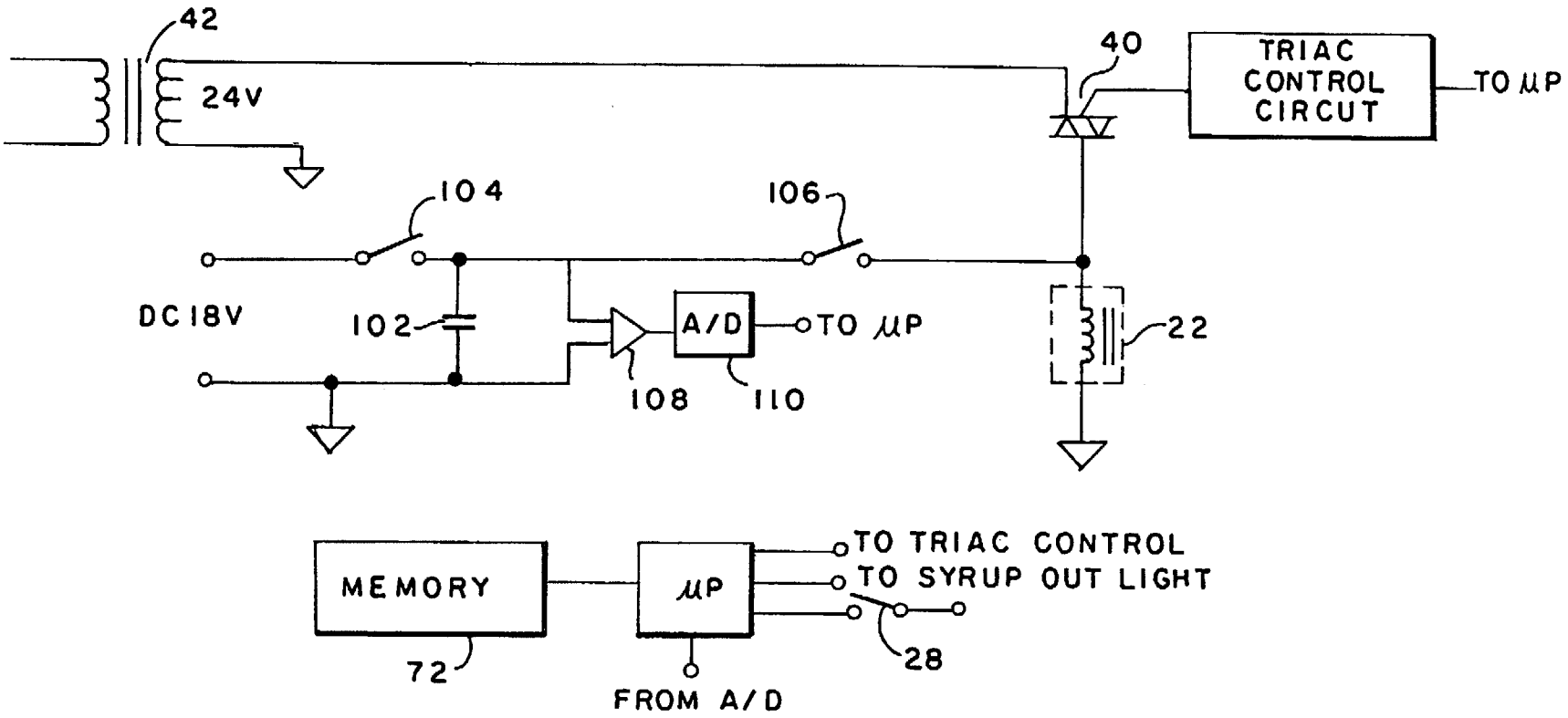

The microprocessor 74 is provided with digital representations of the current waveform as illustrated in FIGS. 4 and 5. FIG. 4 illustrates the current through the resistor 56 to solenoid valve 22 when the syrup reservoir 12 is full and adequate pressure is developed by the pump 14. Specifically, FIG. 4 illustrates the current drawn by the solenoid valve 22 when 20 pounds of syrup back pressure is applied at the dispensing valve 20. FIG. 5, on the other hand, illustrates the current drawn by the solenoid valve 22 with 0 pounds of syrup back pressure at the dispensing valve 20. The two curves differ in several significant respects.

FIGS. 4 and 5 show a current waveform with the vertical axis representing current and arbitrarily scaled. The horizontal axis represents time elapsed and is again arbitrarily scaled.

The waveform in FIG. 5 differs from the waveform in FIG. 4 in several significant respects. First, the waveform in FIG. 5 has two positive-going peaks. The first positive-going peak occurs at approximately horizontal reference 100 and the second peak occurs at approximately horizontal reference 150. The waveform of FIG. 4 has no second peak. The microprocessor 74 can easily detect the presence of a second peak by simply comparing successive current values to the next previous current value. A first peak is detected by the difference going from positive to negative. If the difference returns to a positive value, a second peak has been detected. Applicants have found that the half wave current waveform changes gradually from the shape seen in FIG. 4 to the shape seen in FIG. 5 as the back pressure varies from 20 pounds to 0 pounds. A single intermediate back pressure curve is schematically illustrated in a dashed line representation in FIG. 5. The presence of this second positive-going peak is thus a reliable indicator that the back pressure at the dispensing valve 20 has dropped below 20 pounds and that the syrup reservoir 12 is out of syrup or close to out of syrup. Alternatively, the microprocessor can search for a slope close to horizontal in the second half of the half cycle. This condition will occur at a back pressure higher than that producing a double peak.

Second, the curve in FIG. 5 differs from the curve in FIG. 4 in that the first peak of current occurs earlier in the waveform. Thus, the first peak in FIG. 5 occurs at approximately horizontal reference 100 while the first peak in FIG. 4 occurs at approximately horizontal reference 120. Applicants have found that this peak movement from approximately 120 to approximately 100 occurs gradually as the back pressure at the valve changes from 20 pounds to 0 pounds. The initiation zero crossing in both FIG. 4 and FIG. 5 occurs at the same point at approximately horizontal reference 10. Thus, the time delay between initial zero crossing of the first half wave and the first positive-going peak is a reliable indicator of the syrup back pressure seen at the beverage dispensing valve 20. A time computation in which the interval between zero crossing and first peak occurs is a second reliable indicator of back pressure.

Third, the amplitude of the positive-going peak seen in FIG. 5 differs from that seen in FIG. 4. The amplitude seen in FIG. 4 is approximately 2,250 while the amplitude seen in FIG. 5 is approximately 2,150. It has been found that this amplitude difference changes gradually as back pressure drops and the amplitude difference can be a reliable indicator of back pressure. However, in order to use amplitude changes, one must normalize the curve to compensate for any changes in supply voltage. Normalization information is provided by the operational amplifier 50 and analog to digital converter 52 which supplies a digital waveform representing supply voltage. If supply voltage decreases or increases from nominal, the microprocessor 74 obtains this information from the analog to digital converter 52. Normalization of the amplitude can be accomplished and a reliable indication of back pressure provided.

The memory 72 is provided with the characteristics of current drawn at various known back pressures. The microprocessor 74 compares the characteristics sensed and described above to the stored table of known characteristics to calculate sensed back pressure.

Depending upon the criticality of the application, one, two or all three of the above described parameters can be monitored by the microprocessor 74. If all three parameters are monitored, a very reliable back pressure sensor is provided. Sensed parameters are compared to stored parameters associated with particular pressures and accurate pressure information provided as output.

The above described pressure sensing invention relies solely upon analysis of the electrical current drawn by a conventional solenoid valve 22. No separate pressure transducer is required. No direct contact with the fluid whose pressure is being sensed is required. A back pressure indicative of an out of syrup condition can be selected. The current characteristics associated with this back pressure can then be changed into numeric parameters and stored in memory 72. The current waveform of actual current delivered to the solenoid valve 22 is then analyzed and corresponding numeric parameters created. These numeric parameters are then compared to the parameters from memory indicative of the out of syrup condition and a decision made as to whether the condition exists or not.

In an out of syrup condition, the microprocessor 74 applies a signal to output line 76 which energizes circuitry to illuminate an out of syrup light 78 on the beverage dispensing valve 20. This light will remain illuminated until the syrup reservoir 12 is replenished. Once this occurs, the back pressure at the dispensing valve 20 will return to normal and the beverage dispensing system will return to normal operation with the out of syrup light 78 extinguished. Additionally, an appropriate signal can be applied or withheld on a second output line 80 to the triac controls. The triac 40 is controlled to prevent dispensing of low quality drinks. Different triac control procedures can be programmed. One program allows only one to three half cycles to be applied through the triac 40 in a low syrup condition. This provides sufficient information to sense pressure but not sufficient electrical flow to dispense significant amounts of syrup.

An alternate embodiment of the invention is shown in FIG. 6. Rather than relying upon sensing of the AC current delivered through the triac 40, the embodiment of FIG. 6 uses a direct current approach. A portion of the power provided by the transformer 42 is rectified and regulated to a selected DC voltage, e.g. 18-volts. This 18-volt power is used to charge a capacitor 102. The capacitor 102 is selected to be able to provide significant short term current e.g. 220 microfarads. The capacitor can be isolated from the DC supply by an isolation switch 104. However, the isolation switch is not always necessary.

When a dispense is initiated by closing of the dispense switch 28, the microprocessor 74 does not immediately energize the triac 40. Rather, the microprocessor closes a second isolation switch 106 connecting the charged terminal of the capacitor 102 to the ungrounded terminal of the solenoid valve 22. At the same time, the first isolation switch 104 is opened isolating the capacitor 102 from the 18-volt supply. Switch 106 is held closed for a selected period of time, e.g. 5 milliseconds, and then opened. Ten (10) milliseconds or another time interval can be selected based on circuit conditions. This number can be under program control. An operational amplifier 108 has its inputs connected to the capacitor 102 and measures the voltage across the capacitor. Analog to digital converter 110 creates a digital representation of the voltage on the capacitor 102. As the capacitor 102 is isolated, this voltage represents the total current or energy drawn by the solenoid valve 22 in the 5 milliseconds when the switch 106 was closed. This number is provided to the microprocessor which compares it to a table of known energy draws for various back pressures applied to the solenoid valve 22. If the energy draw number provided by the analog to digital converter 110 indicates normal back pressure, the triac 40 is immediately energized and normal AC current passes to the solenoid valve 22 initiating a beverage dispense. If, however, the number provided by the analog to digital converter 110 indicates an out of syrup condition, the triac 40 is not energized and normal conduction does not occur. The microprocessor 74 then signals an out of syrup condition.

Isolation switches 104, 106 are solid state switches such as transistors. The first isolation switch is not usually required because the charging current from the power supply is negligible when compared to the current drawn by the valve 22.

The DC implementation of FIG. 6 is useful when the 24-volt AC power is not regular. If this 24-volt power varies greatly, the characteristics of the AC current drawn by the solenoid valve 22 can change independently of valve back pressure. If a single 24-volt transformer of small capacity feeds several dispensing valves, erratic supply voltage may occur. In such situations, the DC implementation may perform in a superior manner.

The above described sensor can be used to monitor carbon dioxide gas pressure, or other fluid pressure wherever non-invasive back pressure sensing is required.

While considerable emphasis has been placed on the embodiments illustrated and described herein, it will be appreciated that many of the embodiments of the invention can be made and that the preferred embodiments can be changed in many respects without departing from the principles of the invention. Accordingly, it is to be understood that the foregoing descriptive matter is to be interpreted merely as illustrative of the invention and not as a limitation.

Having thus described the invention, it is claimed:

1. A syrup delivery system for a post-mix beverage dispenser comprising:

a source of syrup providing syrup under pressure;

a conduit accepting syrup from said source of syrup;

an electrically operated valve controlling flow of syrup through said conduit said valve drawing electric current when said valve opens;

a switch controlling said electric current to said valve;

a current sensor measuring electric current through said valve; and, an analyzer analyzing said current for characteristics indicative of back pressure at said valve and creating an out of syrup signal when said back pressure indicates an out of syrup condition.

2. The syrup delivery system of claim 1 wherein said analyzer analyzes said current for characteristics selected from the class consisting of: current amplitude; the time interval between current zero crossing and current peak; and current wave shape.

3. A syrup delivery system for a post-mix beverage dispenser comprising:

a source of syrup providing syrup under pressure;

a conduit accepting syrup from said source of syrup;

an electrically operated valve controlling flow of syrup through said conduit;

a switch controlling electric current flow to said valve;

a current sensor measuring electric current through said valve; and, an analyzer comprising a digital processor, a memory and at least one analog to digital converter; said analog to digital converter creating a digital current signal representative of said sensed current; said digital processor analyzing said digital signal for characteristics indicative of back pressure at said valve and creating an out of syrup signal when said back pressure indicates an out of syrup condition.

4. A syrup delivery system for a post-mix beverage dispenser comprising:

a source of syrup providing syrup under pressure;

a conduit accepting syrup from said source of syrup;

an electrically operated valve controlling flow of syrup through said conduit;

a switch controlling electric current flow to said valve;

a current sensor measuring electric current through said valve; and, an analyzer comprising a digital processor, a memory and at least one analog to digital converter; said analog to digital converter creating a digital current signal representative of said sensed current; said digital processor analyzing said digital signal for characteristics indicative of back pressure at said valve and creating an out of syrup signal when said back pressure indicates an out of syrup condition wherein said digital processor analyzes characteristics from a single half cycle of said sensed current.

5. The syrup delivery system of claim 4 wherein said single half cycle is the first half cycle of current applied to said valve upon closing said switch.

6. A syrup delivery system for a post-mix beverage dispenser comprising:

a source of syrup providing syrup under pressure;

a conduit accepting syrup from said source of syrup;

an electrically operated valve controlling flow of syrup through said conduit;

a switch controlling electric current flow to said valve;

a current sensor measuring electric current through said valve; and, an analyzer comprising a digital processor, a memory and at least one analog to digital converter; said analog to digital converter creating a digital current signal representative of said sensed current; said digital processor analyzing said digital signal for characteristics indicative of back pressure at said valve and creating an out of syrup signal when said back pressure indicates an out of syrup condition wherein said digital processor analyzes said digital current signal for a segment of said signal other than the first peak having a slope close to horizontal.

7. The syrup delivery system of claim 6 wherein said digital processor analyzes said digital current signal for changes in current less than expected for a given time interval.

8. The syrup delivery system of claim 7 wherein said digital processor analyzes said digital current signal for a time interval other than a peak in which current remains constant or the change in current changes sign.

9. A syrup delivery system for a post-mix beverage dispenser comprising:

a source of syrup providing syrup under pressure;

a conduit accepting syrup from said source of syrup;

an electrically operated valve controlling flow of syrup through said conduit;

a switch controlling electric current flow to said valve;

a current sensor measuring electric current through said valve; and, an analyzer comprising a digital processor, a memory and at least one analog to digital converter; said analog to digital converter creating a digital current signal representative of said sensed current; said digital processor analyzing said digital signal for characteristics indicative of back pressure at said valve and creating an out of syrup signal when said back pressure indicates an out of syrup condition wherein said digital processor analyzes said digital current signal for the presence of two peaks in a half circle.

10. A syrup delivery system for a post-mix beverage dispenser comprising:

a source of syrup providing syrup under pressure;

a conduit accepting syrup from said source of syrup;

an electrically operated valve controlling flow of syrup through said conduit;

a switch controlling electric current flow to said valve;

a current sensor measuring electric current through said valve; and, an analyzer comprising a digital processor, a memory and at least one analog to digital converter; said analog to digital converter creating a digital current signal representative of said sensed current; said digital processor analyzing said digital signal for characteristics indicative of back pressure at said valve and creating an out of syrup signal when said back pressure indicates an out of syrup condition wherein said digital processor detects the zero crossing starting a half circle, detects the maximum current of a half cycle indicating a current peak, calculates the time interval between the zero crossing and peak, compares the calculated time interval to stored values corresponding to known conditions and provides an output signal indicative of detected condition.

11. A syrup delivery system for a post-mix beverage dispenser comprising:

a source of syrup providing syrup under pressure;

a conduit accepting syrup from said source of syrup;

an electrically operated valve controlling flow of syrup through said conduit;

a switch controlling electric current flow to said valve;

a current sensor measuring electric current through said valve; and, an analyzer comprising a digital processor, a memory and at least one analog to digital converter; said analog to digital converter creating a digital current signal representative of said sensed current; said digital processor analyzing said digital signal for characteristics indicative of back pressure at said valve and creating an out of syrup signal when said back pressure indicates an out of syrup condition wherein said digital processor detects the maximum current of a half cycle, compares the detected maximum current to stored values corresponding to known conditions and provides an output signal indicative of detected condition.

12. The syrup delivery system of claim 11 further comprising a voltage sensor sensing the voltage applied to said valve; said at least one analog to digital converter creating a digital voltage signal representative of said sensed voltage, said digital processor comparing said sensed digital voltage signal to stored values and calculating a normalization factor and said digital processor applying said normalization factor to said detected maximum current before comparing said detected maximum current to said stored values.

13. A syrup delivery system for a post-mix beverage dispenser comprising:

a source of syrup providing syrup under pressure;

a conduit accepting syrup from said source of syrup;

an electrically operated valve controlling flow of syrup through said conduit;

a switch controlling electric current flow to said valve;

a current sensor measuring electric current through said valve; and, an analyzer comprising a digital processor, a memory and at least one analog to digital converter; said analog to digital converter creating a digital current signal representative of said sensed current; said digital processor analyzing said digital signal for characteristics indicative of back pressure at said valve and creating an out of syrup signal when said back pressure indicates an out of syrup condition wherein said out of syrup signal illuminates an out of syrup light informing an operator of the out of syrup condition.

14. The syrup delivery system of claim 13 wherein said out of syrup signal prevents further opening of the valve.

15. The syrup delivery system of claim 14 wherein said electrically operated valve is a solenoid valve.

16. The syrup delivery system of claim 15 wherein said solenoid valve is normally closed.

17. The syrup delivery system of claim 14 wherein said switch is a triac.

18. The syrup delivery system of claim 17 further comprising a manual switch used to initiate a beverage dispense, said manual switch actuating said digital processor to actuate said current controlling switch except when said current controlling switch is disabled by said digital processor.

19. An out of syrup detector for a beverage dispenser having at least one syrup supply, a solenoid controlled syrup valve drawing electrical current when actuated, said current having certain characteristics of one or more of magnitude, phase shift and wave shape when said syrup supply is out of syrup and a power source supplying electrical current to said solenoid controlled valve, said detector comprising:

a current sensor sensing the current to said solenoid valve; and, an analyzer examining said sensed current and detecting one or more of said certain characteristics indicative of an out of syrup condition if said characteristics exist.

20. An out of syrup detector for a beverage dispenser having at least one syrup supply, a solenoid controlled syrup valve drawing electrical current, said current having certain characteristics when said syrup supply is out of syrup and a power source supplying electrical current to said solenoid controlled valve, said detector comprising:

a current sensor sensing the current to said solenoid valve; and, an analyzer examining said sensed current and detecting a characteristic wave shape comprising a valley and second peak in a selected half wave of an alternating current indicative of an out of syrup condition if said characteristic exists.

21. An out of syrup detector for a beverage dispenser having at least one syrup supply, a solenoid controlled syrup valve drawing electrical current, said current having certain characteristics when said syrup supply is out of syrup and a power source supplying electrical current to said solenoid controlled valve, said detector comprising:

a current sensor sensing the current to said solenoid valve;

an analyzer examining said sensed current and detecting said certain characteristics indicative of an out of syrup condition if such characteristics exist; and, a voltage sensor sensing voltage supplied by said power source, said analyzer using said voltage information to normalize said sensed current.

22. A syrup delivery system for a post-mix beverage dispenser comprising:

a source of syrup providing syrup under pressure;

a conduit accepting syrup from said source of syrup;

an electrically operated valve controlling flow of syrup through said conduit said valve drawing electric current when said valve opens;

a first switch controlling said electric current to said valve;

a sensor measuring electrical energy delivered to said valve; and, an analyzer analyzing said measured electrical energy for characteristics indicative of back pressure at said valve and creating an out of syrup signal when said back pressure indicates an out of syrup condition.

23. The syrup delivery system of claim 22 wherein said analyzer analyzes said energy by analyzing current for characteristics selected from the class consisting of: current amplitude; the time interval between current zero crossing and current peak; and current wave shape.

24. The syrup delivery system of claim 23 wherein said analyzer comprises a digital processor, a memory and at least one analog to digital converter; said analog to digital converter creating a digital current signal representative of said sensed electrical energy; said digital processor analyzing said digital signal for characteristics indicative of back pressure at said valve.

25. The syrup delivery system of claim 22 wherein said sensor comprises a source of electrical energy, an electrical energy storage device, an isolation switch selectively connecting said electrical energy storage device to said valve and a voltage measurer measuring the electrical energy stored in said electrical energy storage device; and, said analyzer comprises a digital processor, a memory and at least one analog to digital converter; said analog to digital convertor creating a digital voltage signal representative of said sensed voltage; said digital processor analyzing said digital signal for characteristics indicative of back pressure at said valve.

26. A syrup delivery system for a post-mix beverage dispenser comprising:

a source of syrup providing syrup under pressure;

a conduit accepting syrup from said source of syrup; an electrically operated valve controlling flow of syrup through said conduit;

a first switch controlling main electric current flow to said valve;

a sensor comprising a source of electrical energy, a capacitor, an isolation switch selectively connecting said capacitor to said valve and a voltage measurer measuring the electrical energy stored in said capacitor; and, an analyzer comprising a digital processor, a memory and at least one analog to digital converter; said analog to digital convertor creating a digital voltage signal representative of said sensed voltage; said digital processor analyzing said digital signal for characteristics indicative of back pressure at said valve, said digital processor controlling said isolation switch and said first switch, said processor holding said first switch open for a selected time period at the beginning of a dispense, closing said isolation switch during said selected time period, opening said isolation switch at the end of said selected time period, retrieving said measured voltage at the end of said time period and comparing said measured voltage to stored voltage values associated with known back pressures and creating an out of syrup signal when said back pressure indicates an out of syrup condition.

27. The syrup delivery system of claim 26 wherein said processor closes said first switch at the end of said time period only if said measured voltage does not indicate an out of syrup condition.

28. The syrup delivery system of claim 26 wherein said selected time period is about five to ten milliseconds.

29. A syrup delivery system for post-mix beverage dispenser comprising:

a source of syrup providing syrup under pressure;

a conduit accepting syrup from said source of syrup;

an electrically operated valve controlling flow of syrup through said conduit;

a first switch controlling electric current flow to said valve;

a sensor measuring electrical energy delivered to said valve; and, an analyzer comprising a digital processor, a memory and at least one analog to digital converter; said analog to digital converter creating a digital current signal representative of said sensed electrical energy; said digital processor analyzing said digital signal for characteristics indicative of back pressure at said valve selected from the class consisting of: current amplitude; the time interval between current zero crossing and current peak; and current wave shape; said digital processor analyzes characteristics from a single half cycle of said sensed current and creating an out of syrup signal when said back pressure indicates an out of syrup condition.

30. The syrup delivery system of claim 29 wherein said single half cycle is the first half cycle of current applied to said valve upon closing said switch.

31. The syrup delivery system of claim 30 wherein said out of syrup signal illuminates an out of syrup light informing an operator of the out of syrup condition.

32. The syrup delivery system of claim 31 wherein said out of syrup signal prevents further opening of the valve.

33. The syrup delivery system of claim 32 wherein said electrically operated valve is a solenoid valve.

34. The syrup delivery system of claim 33 wherein said solenoid valve is normally closed.

35. The syrup delivery system of claim 34 wherein said switch is a triac.

36. The syrup delivery system of claim 35 further comprising a manual switch used to initiate a beverage dispense, said manual switch actuating said current controlling switch except when said current controlling switch is disabled by said digital processor.

37. A method of dispensing flavoring syrup in a beverage dispensing system comprising the steps of:

closing a dispense initiation switch;

delivering electrical current to a normally closed electrically operated valve controlling the flow of flavoring syrup;

sensing at least one characteristic of said delivered electrical current selected from the classes of magnitude, phase shift and wave shape;

comparing said sensed characteristic to a known characteristic indicative of an out of syrup condition and determining if an out of syrup condition exists; continuing with syrup dispensing if an out of syrup condition does not exist; and, creating an out of syrup signal if an out of syrup condition does exist.

* * * * *